US006821172B1

(12) United States Patent
Larson

(10) Patent No.: US 6,821,172 B1
(45) Date of Patent: Nov. 23, 2004

(54) OUTRIGGER ASSEMBLY

(76) Inventor: William J. Larson, 7128 SW. 93rd Ave., Gainesville, FL (US) 32608

( * ) Notice: Subject to any disclaimer, the term of this patent is extended or adjusted under 35 U.S.C. 154(b) by 0 days.

(21) Appl. No.: 10/655,403

(22) Filed: Sep. 5, 2003

(51) Int. Cl.[7] ..... B63H 16/06
(52) U.S. Cl. ..... 440/105
(58) Field of Search ..... 440/101, 104, 440/105, 106, 108

(56) References Cited

U.S. PATENT DOCUMENTS

| | | | | | |
|---|---|---|---|---|---|
| 4,068,611 | A | * | 1/1978 | Leather | 440/105 |
| 4,383,830 | A | | 5/1983 | Cartwright | |
| 4,512,277 | A | * | 4/1985 | Williams | 114/364 |
| 4,516,941 | A | * | 5/1985 | Reid | 440/105 |
| 4,649,852 | A | * | 3/1987 | Piantedosi | 114/363 |
| 5,445,102 | A | * | 8/1995 | Rupp | 114/255 |
| 5,595,517 | A | * | 1/1997 | Smith | 440/104 |
| 5,975,479 | A | * | 11/1999 | Suter | 248/534 |

OTHER PUBLICATIONS

Publication "The Heritage 15 Rowing Dory From Little River Marine" dated Oct. 28, 2002 (and than one year prior to filing date herein).
Publication —Introduction To Sculling "Rowing USA" dated Apr./May. 1985.

* cited by examiner

*Primary Examiner*—Stephen Avila
(74) *Attorney, Agent, or Firm*—Arthur G. Yeager

(57) ABSTRACT

A pivotable outrigger assembly securable to a water vessel gunwale includes a support bracket connected to a receptor extending downwardly from a top planar member of the support bracket. The receptor member preferably includes a stop for receiving a selected inboard and outboard pivot edge rigidly connected to a lower portion of a pivot member. The pivot member includes first and second pivot portions with the former portion being insertable into the receptor from a top planar member opening and the latter extending laterally from the first pivot portion for securing to an oar. A pushpin is insertable from the outer face of the side planar member through the receptor and first pivot portion to secure the pivot member at a selected inboard and outboard position. The receptor includes stationary and movable portions with the former attached to the side planar member of the support bracket and a first receiving portion. The movable portion of the receptor is attached to a second receiving portion having a hole aligned with a hole of the first receiving portion. A threaded attaching member is passed through the two receiving portions via a handle disposed at one end thereof and moves the movable portion of the receptor closer to the stationary portion for tightening the receptor around the first pivot portion. The second receiving portion may include a threaded insert for receiving the attaching member. The stop and the outboard pivot edge may each include a weld for extra support. A substantially solid insert may be inserted into the first pivot portion and includes an aperture therethrough to receive the pushpin. Alternately, the receptor may include a socket at a lower portion thereof for receiving a stop extending outwardly from the first pivot portion. Lifting the first pivot portion a sufficient distance removes the stop from the socket and allow the first pivot portion to be pivoted between inboard and outboard positions.

20 Claims, 5 Drawing Sheets

OUTRIGGER ASSEMBLY

CROSS REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to an outrigger for a water vessel and, more particularly, to a pivotable outrigger including means for selectively locking the outrigger at inboard and outboard positions.

2. Prior Art

Outriggers are commonly used in the rowing and sculling industry to support oars and oarlocks during rowing operations. Typically, a pair of outriggers is secured to a vessel along its opposed gunwales, respectively. While operating the vessel, each outrigger needs to be extended outwardly from the vessel to provide leverage for an oar. When pulling along a dock or transporting the vessel, outriggers should preferably be moved to an inboard position or may be detached from the vessel. Otherwise, the outriggers create difficulties for moving and storing the canoe.

Some prior art outriggers have been proposed which are removable from the canoe, but often require tools for unscrewing fasteners and related parts. To overcome such problems, other prior art outriggers have been proposed that include singable parts and are repositionable between inboard and outboard positions without having to employ tools for removing secured parts thereof. Unfortunately, a shortcoming of such prior art outriggers is their requisite number of mechanical components that become subject to fatigue and/or failure after repeated use. U.S. Pat. No. 4,383,830 to Cartwright and U.S. Pat. No. 4,516,941 to Reid illustrate such prior art outriggers.

Accordingly, there exists a need for a lightweight outrigger that includes few mechanical parts that are capable of withstanding various forces thereon as well as capable of being quickly and easily pivoted between inboard and outboard positions.

BRIEF SUMMARY OF THE INVENTION

In view of the foregoing background, it is therefore an object of the invention to provide a pivotable outrigger. These and other objects, features, and advantages of the invention, are provided by a pivotable outrigger assembly securable to a water vessel gunwale. The outrigger assembly includes a bracket including a top planar member having parallel upper and lower surfaces and a side planar member having parallel inner and outer surfaces integral therewith and generally perpendicular to the top planar member. Each of the top and side members have a plurality of spaced holes for receiving corresponding attachment members therethrough for securing the bracket to a water vessel gunwale with the side planar member being disposed inboard thereof. The side planar member has a pinhole formed therethrough and the top planar member has a receptor opening formed generally medially thereof.

The outrigger assembly further includes an elongate receptor member having a hollow interior with a top end thereof rigidly secured to the lower surface of the top planar surface and aligned with the receptor opening and extending downwardly therefrom. The receptor has a pair of diametrically spaced pinholes alignable with the pinhole of the side planar member.

An elongate outrigger member includes a first pivot portion having a bottom end removably insertable into the receptor and a top end extending upwardly therefrom. The first pivot portion has a pair of pin passages alignable with and parallel to the pair of pinholes of the receptor and the pinhole of the side planar member when the first pivot portion is pivoted to selected inboard and outboard positions. A second pivot portion has one end attached to the top end of the first pivot portion and an opposite end disposed generally laterally therefrom for attachment of an oarlock adjacent the opposite end.

The outrigger assembly further includes means for selectively locking the first pivot portion within the receptor. The latter means includes a locking pin removably insertable into the pinhole of the side planar member and the pair of pinholes of the receptor and the pair of passages of the first pivot portion after same has been pivoted within the receptor to a selected inboard and outboard positions. The receptor includes a stationary portion and a movable portion integral therewith and adapted to be tightened and loosened around the first pivot portion.

The means for selectively locking the first pivot portion within the receptor further includes an elongate handle and an elongate threaded fastener having one end attached to the handle and extending laterally therefrom. A receiving member includes first and second spaced receiving portions disposed on the outboard side of the side planar member. The first portion is preferably firmly attached to the outer surface of the side planar member and to the stationary portion of the receptor. The second portion is preferably firmly attached to the moveable portion of the receptor and may include a durable threaded insert into which a fastener is threaded. The insert may be formed of stainless material.

The first portion may have a non-threaded passageway extending therethrough perpendicularly to the side planar member for freely receiving the threaded fastener therethrough with the second portion preferably having a threaded passageway aligned with the non-threaded passageway for threadedly receiving the threaded fastener. The threaded fastener may be tightenable between the inner surface of the planar member and the second portion to tighten the receptor movable portion about the first pivot portion of the outrigger member to inhibit pivoting thereof when the threaded fastener is fully tightened.

The means for selectively locking the first pivot portion within the receptor may further includes cooperating stop means including an inboard pivot edge and a spaced outboard pivot edge integral with and formed at the bottom end of the first pivot portion, and a stop substantially rigidly attached within the receptor. The stop preferably includes an outboard stop edge and an inboard stop edge oppositely spaced therefrom. The inboard stop edge may have a weld for reinforcing the stop during engagement of the outboard pivot edge with the outboard stop edge. The means for locking may include a male element on one of the members and a female socket on another of the members for receiving the male element.

The stop means may further includes a reinforcing arcuate member and a weld for connecting the reinforcing member to the outboard pivot edge for providing additional contact surface for engagement with the stop. The reinforcing member preferably has a thickness substantially equal to a thickness of the bottom end of the first pivot portion. The receptor may have a thickness substantially equal to a thickness of the bottom end of the first pivot portion. The receptor has inner and outer walls and the stop may have an outer portion passing through a passage through the receptor walls. The stop may be welded about the outer portion to the outer wall.

The means for selectively locking the first pivot portion within the receptor may further include a substantially solid stop member having an upper end attached to and within the bottom end of the first pivot portion and a reduced lower end integral with the upper end and disposed generally centrally thereof. The reduced lower end of the stop member extends downwardly from the bottom end of the first pivot portion. The receptor preferably has a lower portion including a socket disposed centrally thereof for receiving the reduced lower end. The first pivot portion is pivotable within the receptor after removing the locking pin and sufficiently lifting the first pivot portion upwardly so that the reduced lower end clears the socket thereby allowing the first pivot portion to freely move within the receptor between inboard and outboard positions.

The first pivot portion may include a substantially solid insert affixed therewithin adjacent the bottom end. The insert preferably has an aperture extending therethrough and aligned with the pair of pinholes of the receptor and the pin passages of the first pivot portion. The aperture receives the locking pin to inhibit movement of the first pivot portion between the inboard and outboard positions. The insert may be welded within the first pivot portion and the locking pin may be a quick-release locking pin. The first portion is substantially tubular and the receptor may be formed from aluminum. The second pivot portion may also be substantially tubular.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout, and prime notations are used to indicate similar elements in alternate embodiments.

Figure 1:
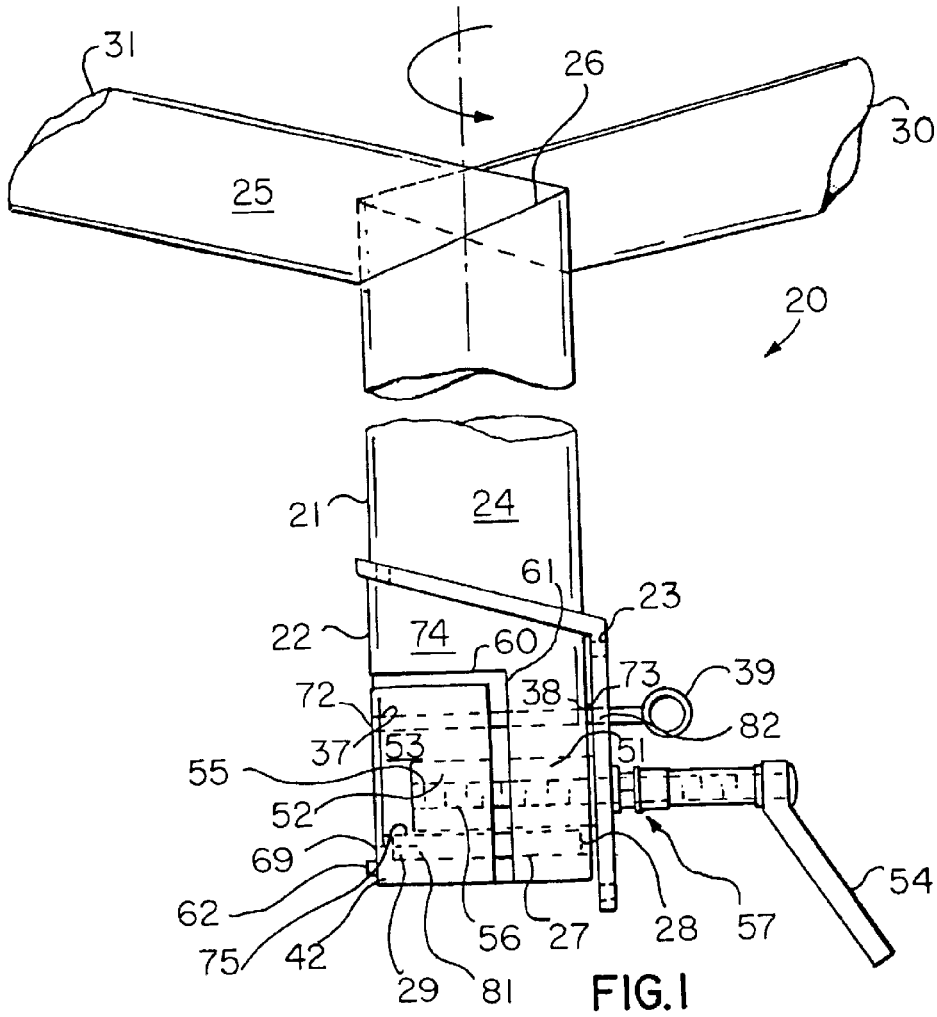
FIG. 1 is a partial rear elevational view of an outrigger assembly with the outrigger movable between inboard and outboard positions, in accordance with the present invention.
Figure 10:
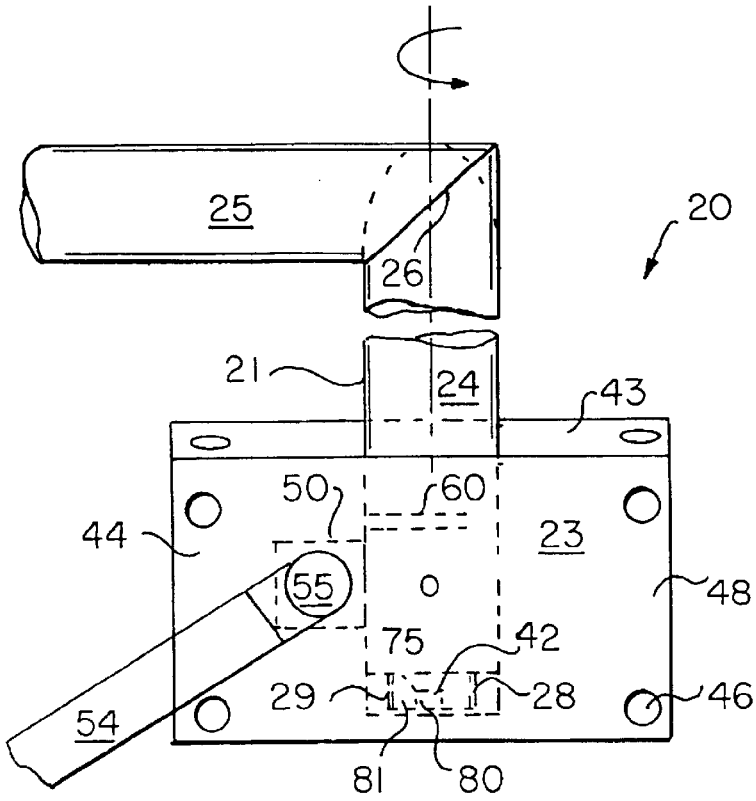
FIG. 10 is an inboard side elevational view of the outrigger.

An outrigger 20, generally shown in FIGS. 1 and 10, includes a pivot member 21 removably insertable into a receptor 22 that is attached to a support bracket 23. The pivot member 21 is preferably tubular and includes a first elongate pivot portion 24 and a second elongate pivot portion 25 attached thereto. The first pivot portion 24 has a top end 26 attached to one end of the second pivot portion 25 and a bottom end 27 insertable into the receptor 22. The bottom end 27 defines a pair of pivot edges 28, 29, respectively, that extend a predetermined distance downwardly and substantially perpendicularly therefrom so that they are able to engage a stop 42 attached to the inner wall 69 (FIG. 14) of the receptor 22 when the pivot member 21 is pivoted between an inboard position 30 and an outboard position 31.

Figure 2:
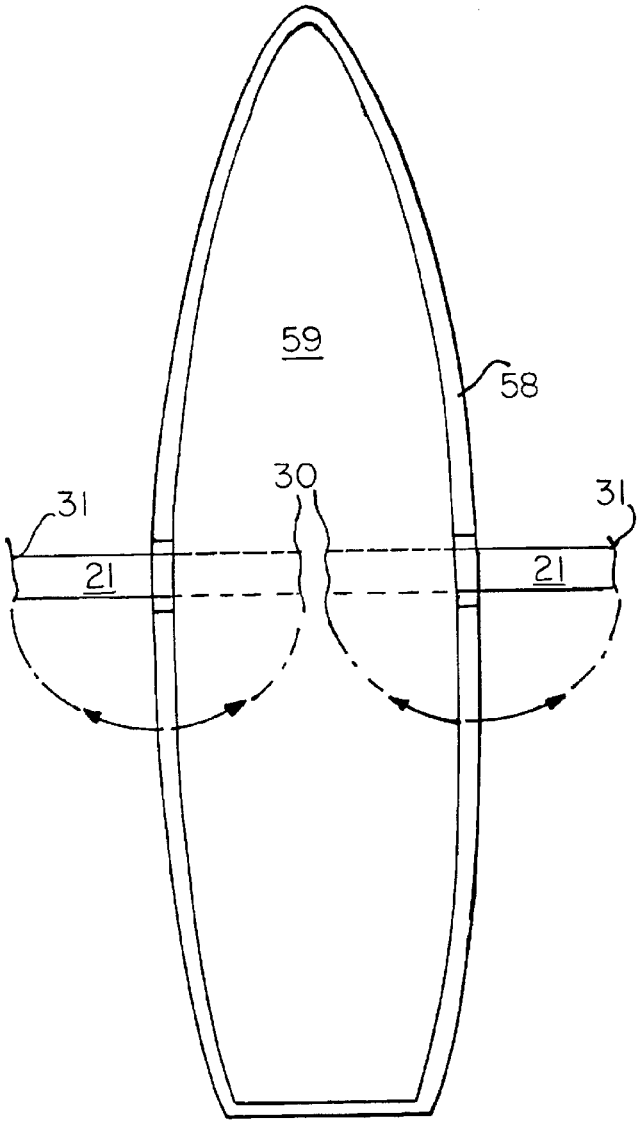
FIG. 2 is a partial top plan view of a pair of outrigger assemblies secured to the gunwales of a canoe.
Figures 3, 4, 5, 6, 7, 8, 9:
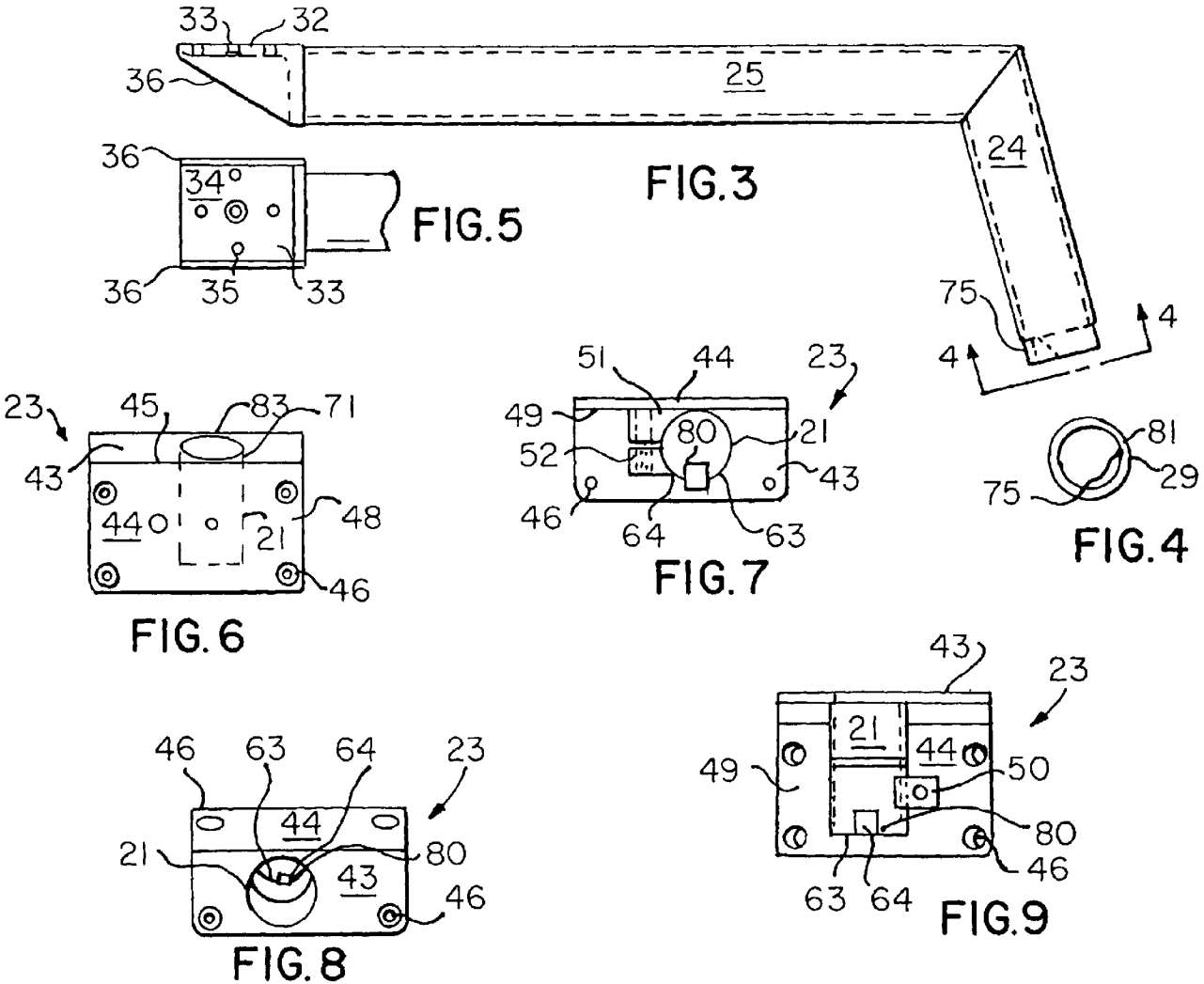
FIG. 3 is a side elevational view of the outrigger shown in FIG. 1.
FIG. 4 is a partial bottom view of FIG. 3 taken along line 44, and the reinforcing member secured to the outrigger.
FIG. 5 is a partial bottom plan view of the oarlock support end of the outrigger.
FIG. 6 is an inboard side elevational view of the bracket shown in FIG. 1.
FIG. 7 is a bottom plan view of the bracket shown in FIG. 1.
FIG. 8 is a top plan view of the bracket shown in FIG. 1 with the top planar member perpendicular to a horizontal plane.
FIG. 9 is an outboard side elevational view of the bracket shown in FIG. 1.

As perhaps best shown in FIG. 4, such pivot edges 28, 29 are defined at the perimeter of the bottom end 27 of the first pivot portion 24 and limit the movement thereof while same is disposed within the receptor 22. Accordingly, pivot edges 28, 29 are preferably spaced apart from each other by approximately 180 degrees for allowing pivot member 21 to pivot in the manner clearly shown in FIG. 2, which illustrates a preferable inboard position 30 and a preferable outboard position 31, for example.

Referring back to FIGS. 1 and 10, the stop 42 is attached both to the inner and outer walls of the receptor 22 and is selectively positioned for cooperating with pivot edges 28, 29 to limit the pivoting movement of the pivot member 21, as noted above. In particular, the stop 42 has an outer face 62 that passes through the wall of the receptor 22 and is attached thereto adjacent the bottom end of the receptor 22. As perhaps best shown in FIGS. 7–9, the stop 42 is also provided with oppositely spaced edges 63, 64 for engaging the pivot edges 28, 29, respectively. The outboard stop edge 64 has a thicker surface so that a corresponding outboard pivot edge 29 does not damage the stop 42 as such a pivot edge 29 is pivoted and engaged thereagainst during outboard movements of the pivot member 21.

A weld 80 preferably reinforces the outboard stop edge 64 so that, when the pivot edge 29 is pivoted and engaged thereagainst, the outboard stop edge 64 does not become damaged. Advantageously, the receptor wall 69 may be formed to be thinner than would normally be required for withstanding the pivoting force of the outboard pivot edge 29 during operating conditions because the weld 80 at the outboard stop edge 64 will provide extra support for the receptor wall 69. Likewise, as best shown in FIG. 4, the reinforcing member 75 attached to the outboard pivot edge 29 preferably includes a weld 81 so that the reinforcing member 75 and the first pivot portion 24 form a rigid surface and thereby may have thinner walls than would normally be required under operating conditions. Such thinner walls also provide for a lighter pivot member 21.

Such an advantage can be helpful when pivoting the pivot member 21 between inboard and outboard positions 30, 31, respectively, because less effort would be required to pivot a lighter pivot member 21 and also make it easier to transport the outrigger 20 without having to remove the pivot member 21 from the receptor 22. Also, because the reinforcing member 75 for the outboard pivot edge 29 and the stop 42 preferably include extra weld, such members may also be formed of lightweight material such as aluminum or other suitable materials without compromising their durability.

Now referring to FIGS. 3–5, the second pivot portion 25 extends outwardly and generally perpendicularly from the first pivot portion 24. A free end 32 of the second pivot portion 25 defines an oarlock 33 for securing an oar (not shown) thereto. Such an oarlock 33 has a substantially planar top surface 34 that has a plurality of holes 35 for securing an oar (not shown) thereto via a plurality of fasteners (not shown). The oarlock also has triangular sidewalls 36 to help secure the weight of an oar on the top surface 34 thereof.

Referring once again to FIGS. 1 and 10, the first pivot portion 24 is provided with a pair of pin passageways 37, 38, the receptor 22 is provide with a pair of corresponding pin holes 72, 73, and the side planar member 44 of the bracket 23 is provided with a pin hole 82. Such passageways 37, 38 and holes 72, 73, 82 are all aligned with each so that a quick-release pin or pushpin 39 is removably insertable therethrough for helping to maintain the pivot member 21 at a locked inboard position 30 or outboard position 31. Advantageously, the pushpin 39 is insertable completely through the first pivot portion 24 thereby engaging same at two opposed locations for preventing the pivoting of the pivot member 21 during operating conditions.

Referring to FIGS. 6–9, the receptor 22 has a hollow tubular shape and is provided with a top end 71 that is in continuous contact with a receptor opening 83 formed at the top planar member 43 of the bracket 23. The opening 83 is positioned generally medially of the top planar member 43 and receives the first pivot portion 24 of the pivot member 21 therethrough. The top planar member 43 is substantially planar and is integral with a side planar member 44 thereof. Such bracket faces 43, 44 share an edge 45 extending from one end of the bracket 23 to the opposed end and are generally perpendicular to each other. Further, both top and side planar members 43, 44 are provided with a plurality of spaced holes, generally shown at 46, for securing the bracket 23 to a gunwale 37 of a canoe 59 via fastening members (not shown), as perhaps best shown in FIG. 2.

The side planar member 44 of the bracket 23 is also substantially planar and has an inboard side 48 and an outboard side 49. Such an outboard side of the side planar member 44 is attached to the receptor 22 and to a first portion 51 of a receiving member 50. As best shown in FIGS. 1 and 10, a second portion 52 of the receiving member 50 is bonded to a movable portion 53 of the receptor 22 and is spaced from the first receiving portion 51. Such receiving portions 51, 52 increase and decrease the diameter of the receptor 22 for securing the pivot member 21 therein, as will be explained hereinbelow. To help in maintaining the movable portion 53 of the receptor 22 at a desired position, the second receiving portion 52 includes an insert 56 therein for receiving a fastener 55 as same is threaded therethrough. The insert 56 is preferably formed of stainless steel and has a threaded interior surface.

An elongate handle 54 has one end connected to a corresponding end of a fastener 55 and extends generally perpendicularly outwardly therefrom. Such a fastener 55 is preferably threaded and long enough for penetrating through the side planar member 44 of the bracket 23 and the first 51 and second 52 receiving portions of the receiving member 50. The handle 54 rotates the fastener 55 for tightening and loosening the first pivot portion 24 within the receptor 22. Accordingly, the pivot member 21 may be selectively tightened and loosened within the receptor 22 even after the pushpin 39 is removed therefrom. A plurality of washers and covers, generally shown at 57, help maintain and protect the fastener 55 during operating conditions.

In particular, the movable portion 53 of the receptor 22 is defined by a substantially horizontal slit 60 extending across a top portion thereof and a substantially vertical slit 61 extending downwardly from one end of the horizontal slit 60 towards a bottom end of the receptor 22. The width of the vertical slit 61 is defined by the spacing between the first and second receiving portions 51, 52, respectively, so that as the handle 54 is rotated in a tightening direction, the fastener 55 is threaded through the first and second receiving portions 51, 52 thereby causing the movable portion 53 of the receptor 22 to move inwardly toward the stationary portion 74 of the receptor 22 for tightening same around the first pivot portion 24. Advantageously, as noted above, if the pushpin 39 is accidentally disengaged from the first pivot portion 24, same may be maintained at a stationary position until the pushpin 39 is reinserted therein.

Figure 11:
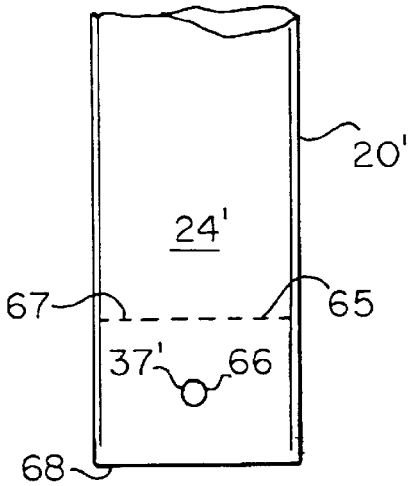
FIGS. 11–12 are partial views of the first pivot portion and the receptor, in accordance with an alternate embodiment of the present invention.
Figure 12:
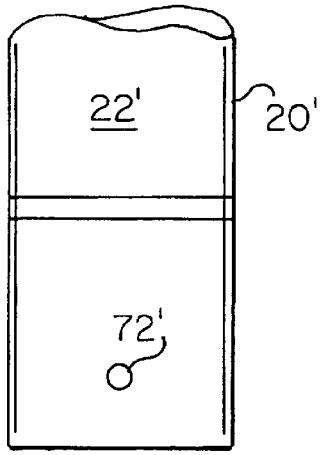
Figure 15:
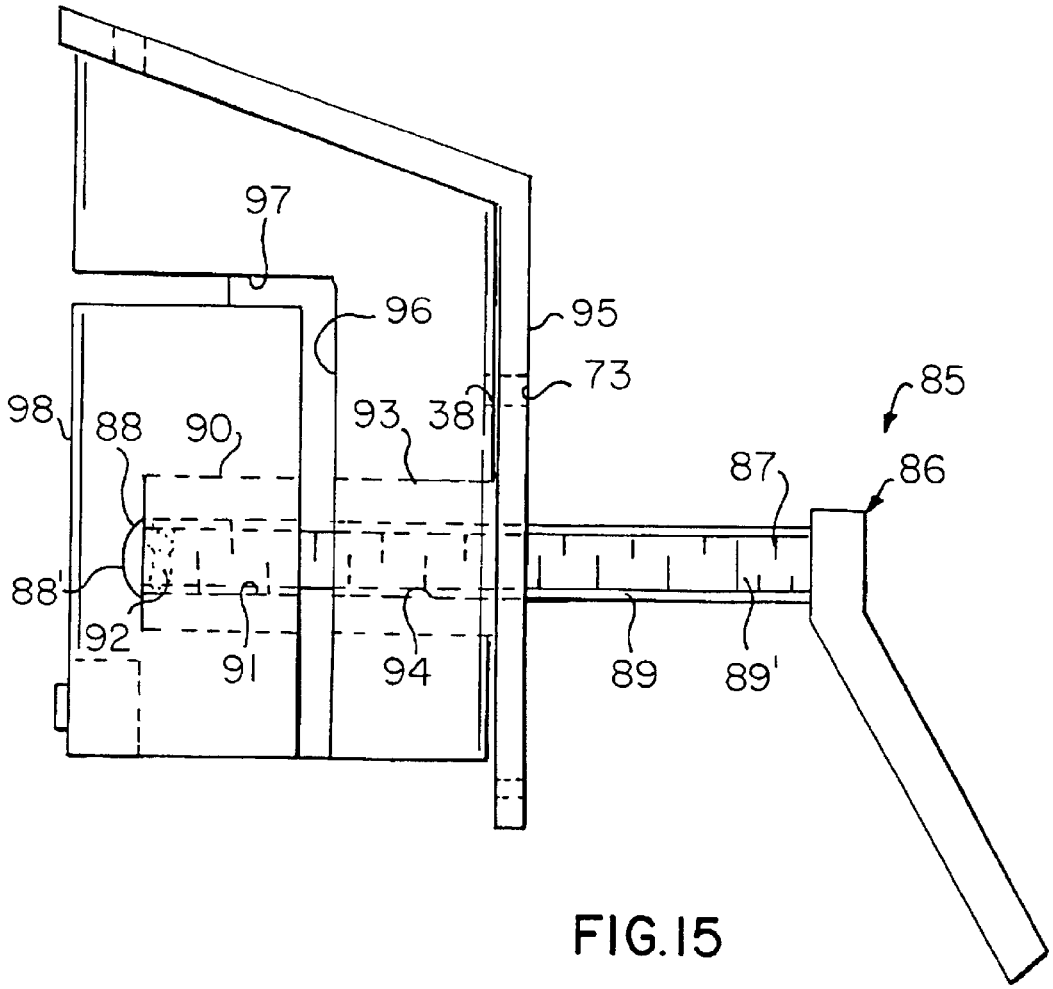
FIG. 15 is a partial view of an alternative embodiment of the securing apparatus in accord with the present invention.

Now referring to FIGS. 11 and 12, an alternate embodiment of the outrigger 20' is shown wherein the receptor 22' receives a first pivot portion 24' preferably including a substantially solid substantially solid insert 65 welded to a lower portion of the first pivot portion 24' and having substantially the same shape as the hollow interior of the receptor 22'. An aperture 66 is formed in the substantially solid insert 65 and extends through the first pivot portion 24' substantially parallel to the aligned pin holes 37', 38' including hole 72' of receptor 22', all corresponding to outboard and inboard positions 31, 30, of FIG. 2. Such an aperture 66 provides a path for the pushpin 39 to be positioned therethrough and assists in maintaining the first pivot portion 24' at selectively locked inboard and outboard positions.

Figure 13:
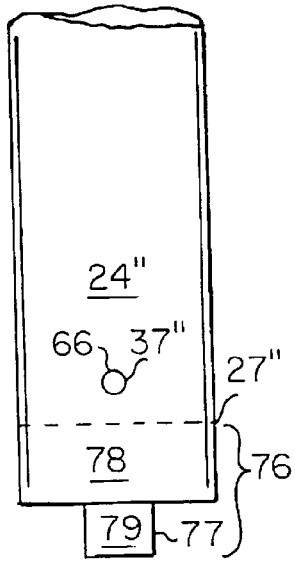
FIGS. 13–14 are partial views of the first pivot portion and the receptor, in accordance with another embodiment of the present invention.
Figure 14:
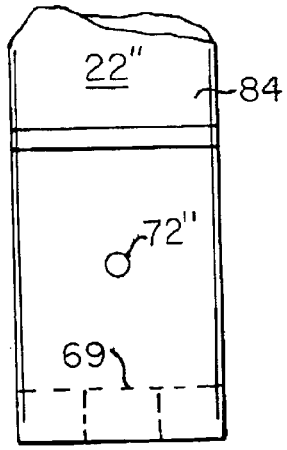

Now referring to FIGS. 13 and 14, another embodiment of the outrigger 20" is shown wherein the assembly 20" includes a stop 76 attached to the bottom end 27" of the first pivot portion 24" and has a substantially square shape with perpendicular corners insertable into a socket 69" disposed at a lower portion of the receptor 22". More specifically, the stop 76 has a wider upper portion 78 having substantially the same shape as the hollow interior of the first pivot portion 24" and attached therein. A narrower lower portion 79 is integral with the upper portion 78 and is disposed generally centrally thereof. Such a lower portion 79 extends outwardly a predetermined distance from the bottom end 27" of the first pivot portion 24".

The upper interior portion 84 of the receptor 22" is hollow with sufficient width for receiving the bottom end 27" of the first pivot portion 24" and the stop 76 therethrough. The socket 69" is formed at a lower portion of the receptor 22" and is spaced centrally thereof between the walls of the receptor 22". The socket has a generally square shape and is formed to receive the bottom portion 79 of the stop 76. Accordingly, the first pivot portion 24" and stop portion 79 are insertable into the lower portion of the receptor 24" whereat stop portion 79 fits into socket 69" to inhibit the pivot member 24", 25" from pivoting. As desired, the pivot member may be pivoted between inboard and outward positions by, inter alia, lifting the slot portion 79 out of the socket 69" and rotating same. Of course, the general shape of the stop portion 79 and socket 69" may included other complementary shapes such as triangular shapes and rectangular shapes, for example.

Now referring back to FIGS. 1, 10, 11, and 12 the first two embodiments of the outrigger 20, 20', respectively, are operable as described hereinbelow. The pushpin 39 may be removed from the first pivot portion 24, 24' and receptor 22, 22', respectively, followed by loosening the movable portion 53 of the receptor via handle 54. The pivot member 21, 21' is now free to pivot between inboard and outboard positions 30, 31, respectively, while disposed within the receptor 22, 22'. More specifically, pivot member 21 may be pivoted between pivot edges 28, 29 and pivot member 21' may be pivoted between opposed ends of aperture 66. Both pivot members 21, 21' may be pivoted without needing to vertically lift the first pivot portion 24, 24' from its rested position inside the receptor 22, 22'. Once the pivot member 21, 21' is at a desired inboard position 30 or outboard position 31, the movable end 53 of the receptor 22, 22' should be tightened around the first pivot portion 24, 24' via handle 54 and the pushpin 39 should be reinserted into the first pivot portion 24, 24' for locking same in place.

In operating the third embodiment 20", an operator must lift the first pivot portion 24" a sufficient vertical distance from its rested position inside the socket 69, in addition to the above mentioned steps, so that the stop 76 may be rotated without engaging the inner walls of the socket 69. Advantageously, the second and third embodiments 20', 20" may rotate freely, or 360 degrees, because such embodiments do not include pivot edges for limiting the pivot movement of the respective first pivot portions 24', 24".

An alternate preferred embodiment of the outrigger is illustrated at 85 and includes handle 86 having a threaded recess 87 sized to accept a threaded bolt 88 having a head 88' and threaded shank 89. The bolt 88 extends to end 89' and passes through first portion of receiving member 90 having a threaded passageway 91 therethrough and through a second portion of receiving member 93 having a non-threaded passageway 94 therethrough. The bolt 88 is further secured in place via epoxy 92 or similar appropriate adhesive.

The bracket 95 includes vertical slit 96 and horizontal slit 97 that assists in defining pivot member 98. The bracket 95 is preferably substantially identical to brackets of FIGS. 1–14. Movement of the bolt 88 and the resultant width of vertical slit 96 is controlled by rotation of handle 86 as discussed hereinabove.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A pivotable outrigger assembly securable to a water vessel gunwale, said outrigger assembly comprising:

a bracket including a top planar member having parallel upper and lower surfaces and a side planar member having parallel inner and outer surfaces integral therewith and generally perpendicular to said top planar member, each said top and side members having a plurality of spaced holes for receiving corresponding attachment members therethrough for securing said bracket to a water vessel gunwale with said side planar member being disposed inboard thereof said top planar member having a receptor opening formed generally medially thereof;

an elongate receptor member having a hollow interior with a top end thereof rigidly secured to said lower surface of said top planar surface and aligned with said receptor opening and extending downwardly therefrom; and an elongate outrigger member including a first pivot portion having a bottom end removably insertable into said receptor and a top end extending upwardly therefrom, and a second pivot portion having one end attached to said top end of said first pivot portion and an opposite end disposed generally laterally therefrom for attachment of an oarlock adjacent said opposite end; and positive means for selectively fixing said first pivot portion within said receptor in at least two positions.

2. The outrigger assembly of claim 1, wherein said receptor member includes a stationary portion and a movable portion integral therewith and being adapted to be tightened and loosened around said first pivot portion.

3. The outrigger assembly of claim 2, wherein said means for selectively locking said first pivot portion within said receptor further includes an elongate handle and an elongate threaded fastener having one end attached to said handle and extending laterally therefrom; and a receiving member including first and second spaced receiving portions disposed on the outboard side of said side planar member, said first portion being firmly attached to said outer surface of said side planar member and to said stationary portion of said receptor, said second portion being firmly attached to said moveable portion of said receptor, said first portion having a non-threaded passageway extending therethrough perpendicularly to said side planar member for freely receiving said threaded fastener therethrough, said second portion having a threaded passageway aligned with said non-threaded passageway for threadedly receiving said threaded fastener, said threaded fastener being tightenable between said inner surface of said planar member and said second portion to tighten said receptor movable portion about said first pivot portion of said outrigger member to inhibit pivoting thereof when said threaded fastener is fully tightened.

4. The outrigger assembly of claim 3, wherein said second portion includes a durable threaded insert into which said fastener is threaded.

5. The outrigger assembly of claim 3, wherein said means for selectively locking said first pivot portion within said receptor further includes cooperating stop means including an inboard pivot edge and a spaced outboard pivot edge integral with and formed at said bottom end of said first pivot portion; and a stop substantially rigidly attached within said receptor, said stop including an outboard stop edge and an inboard stop edge oppositely spaced therefrom, said inboard stop edge having a weld for reinforcing said stop during engagement of said outboard pivot edge with said outboard stop edge.

6. The outrigger assembly of claim 5, wherein said stop means further includes a reinforcing arcuate member and a weld for connecting said reinforcing member to said outboard pivot edge for providing additional contact surface for engagement with said stop.

7. The outrigger assembly of claim 6, wherein said reinforcing member has a thickness substantially equal to a thickness of said bottom end of said first pivot portion.

8. The outrigger assembly of claim 1, wherein said receptor has a thickness substantially equal to a thickness of said bottom end of said first pivot portion.

9. The outrigger assembly of claim 5, wherein said receptor has inner and outer walls and said stop having an outer portion passing through a passage through said receptor walls, said stop being welded about said outer portion to said outer wall.

10. The outrigger assembly of claim 3, wherein said means for selectively locking said first pivot portion within said receptor further includes a substantially solid stop member having an upper end attached to and within said bottom end of said first pivot portion and a reduced lower end integral with said upper end and disposed generally centrally thereof, said reduced lower end of said stop member extending downwardly from said bottom end of said first pivot portion, said receptor having a lower portion including a socket disposed centrally thereof for receiving said reduced lower end.

11. The outrigger assembly of claim 1 wherein said side planar member has a pin hole formed therethrough, said receptor having a pair of diametrically spaced pin holes alignable with said pin hole of said side planar member and said first pivot portion having a pair of pin passages alignable with and parallel to said pair of pin holes of said receptor and said pin holes of said receptor and said pin hole of said side planar member when said first pivot portion is pivoted to selected inboard and outboard positions, said means for selectively locking said first pivot position with said receptor including a locking pin assembly removably insertable into said pin hole of said side planar member and said pair of pin holes of said receptor and said pair of pin passages of said first pivot portion after said first pivot portion has been pivoted within said receptor to a selected inboard and outboard positions.

12. The outrigger assembly as defined in claim 11 wherein said first pivot portion is pivotable within said receptor after removing said locking pin and sufficiently lifting said first pivot portion upwardly so that said reduced lower end clears said socket allowing said first pivot portion to freely move within said receptor between inboard and outboard positions.

13. The outrigger assembly of claim 11, wherein said first pivot portion includes a substantially solid insert affixed therewithin adjacent said bottom end, said insert having an opening extending therethrough and aligned with said pair of pin holes of said receptor and said pin passages of said first pivot portion, said opening receiving said locking pin to inhibit movement of said first pivot portion between said inboard and outboard positions.

14. The outrigger assembly of claim 13, wherein said insert is welded within said first pivot portion.

15. The outrigger assembly of claim 1, wherein said first portion is substantially tubular.

16. The outrigger assembly of claim 1, wherein said means for locking includes a male element on one of said members and a female socket on another of said members for receiving said male element.

17. A pivotable outrigger assembly securable to a water vessel gunwale, said outrigger assembly comprising:

a bracket including a top planar member having parallel upper and lower surfaces and a side planar member having parallel inner and outer surfaces integral therewith and generally perpendicular to said top planar member, each said top and side members having a plurality of spaced holes for receiving corresponding attachment members therethrough for securing said bracket to a water vessel gunwale with said side planar member being disposed inboard thereof, said top planar member having a receptor opening formed generally medially thereof;

an elongate receptor member having a hollow interior with a top end thereof rigidly secured to said lower surface of said top planar surface and aligned with said receptor opening and extending downwardly therefrom; said receptor member includes a stationary portion and a movable portion integral therewith and being adapted to be tightened and loosened around said first pivot portion;

an elongate outrigger member having a first pivot portion having a bottom end removably insertable into said receptor and a top end extending upwardly therefrom, and a second pivot portion having one end attached to said top end of said first pivot portion and an opposite end disposed generally laterally therefrom for attachment of an oarlock adjacent said opposite end;

positive lock means for selectively fixing said first pivot portion within said receptor in at least two positions.

18. The outrigger assembly of claim 17 wherein said means for selectively locking said first pivot portion within said receptor includes an elongate handle having a laterally extending elongate threaded recess therein, a first and second receiving portion disposed on the outboard side of said side planar member, said first receiving portion being firmly attached to said outer surface of said side planar member and to said stationary portion of said receptor, said second receiving portion being firmly attached to said movable portion of said receptor, each said receiving portion having a passageway therethrough aligned and extending perpendicular to said side planar member, a bolt having a head and a threaded shank portion positioned through said passageways and threadably engaged into said threaded recess in said handle.

19. The outrigger assembly of claim 18 wherein said passageway in said second receiving portion is threaded for threadably engaging said threaded shank portion of said bolt to inhibit rotation of said bolt when said handle is operated by a user.

20. The outrigger assembly of claim 19 wherein said means for selectively locking includes adhesive placed in said threaded passageway to inhibit rotation of said bolt when said handle is operated by a user.

* * * * *